US009366388B2

(12) United States Patent
Krause et al.

(10) Patent No.: US 9,366,388 B2
(45) Date of Patent: Jun. 14, 2016

(54) REFRIGERATOR APPLIANCE AND A METHOD FOR MONITORING A WATER FILTER ASSEMBLY WITHIN THE SAME

(71) Applicant: General Electric Company, Schenectady, NY (US)

(72) Inventors: Andrew Reinhard Krause, La Grange, KY (US); Natarajan Venkatakrishnan, Louisville, KY (US); Jonathan Charles Crosby, Louisville, KY (US); Tyler James Doering, Louisville, KY (US)

(73) Assignee: General Electric Company, Schenectady, NY (US)

( * ) Notice: Subject to any disclaimer, the term of this patent is extended or adjusted under 35 U.S.C. 154(b) by 480 days.

(21) Appl. No.: 14/052,847

(22) Filed: Oct. 14, 2013

(65) Prior Publication Data

US 2015/0101669 A1 Apr. 16, 2015

(51) Int. Cl.
*F17D 3/01* (2006.01)

(52) U.S. Cl.
CPC ..... *F17D 3/01* (2013.01); *Y10T 137/0318* (2015.04); *Y10T 137/8158* (2015.04)

(58) Field of Classification Search
None
See application file for complete search history.

(56) References Cited

U.S. PATENT DOCUMENTS

| | | | |
|---|---|---|---|
| 5,089,144 | A | 2/1992 | Ozkahyaoglu et al. |
| 5,190,666 | A | 3/1993 | Bisconte |
| 5,192,424 | A | 3/1993 | Beyne et al. |
| 5,328,597 | A | 7/1994 | Boldt, Jr. et al. |
| 6,009,404 | A | 12/1999 | Eimer |
| 6,051,144 | A | 4/2000 | Clack et al. |
| 6,303,031 | B1 | 10/2001 | Senner |
| 6,355,177 | B2 | 3/2002 | Senner et al. |
| 6,533,926 | B2 | 3/2003 | Hawkins et al. |
| 6,537,444 | B2 | 3/2003 | Wilberscheid et al. |
| 6,551,503 | B2 | 4/2003 | Niers et al. |
| RE39,361 | E | 10/2006 | Den Dekker |
| 7,481,917 | B2 | 1/2009 | Ikeyama et al. |
| 7,638,042 | B2 | 12/2009 | Astle et al. |
| 7,836,708 | B2 | 11/2010 | Krause et al. |
| 8,118,997 | B2 | 2/2012 | Ebrom et al. |
| 8,282,820 | B2 | 10/2012 | Cur et al. |
| 2002/0189983 | A1 * | 12/2002 | Guess ..... G01D 35/143 210/87 |
| 2004/0007516 | A1 | 1/2004 | Fritze et al. |
| 2004/0251210 | A1 | 12/2004 | Fritze et al. |
| 2006/0011523 | A1 | 1/2006 | Schrott et al. |

(Continued)

FOREIGN PATENT DOCUMENTS

| | | |
|---|---|---|
| EP | 1936305 | 6/2008 |
| JP | 2003192096 A | 7/2003 |

(Continued)

OTHER PUBLICATIONS

PCT Search Report and Written Opinion issued in connection with corresponding Application No. PCT/US2014/056282 on Nov. 27, 2014.

*Primary Examiner* — Chester Barry
(74) *Attorney, Agent, or Firm* — Dority & Manning, P.A.

(57) ABSTRACT

A refrigerator appliance and a method for monitoring a water filter assembly within the same are provided. The method includes monitoring signal communication between an RFID tag of the water filter assembly and an RFID reader of the refrigerator appliance and terminating a flow of water to the water filter assembly if the signal communication between the RFID tag of the water filter assembly and the RFID reader of the refrigerator appliance is lost or disrupted.

19 Claims, 8 Drawing Sheets

(56) References Cited

U.S. PATENT DOCUMENTS

| | | | |
|---|---|---|---|
| 2006/0186031 | A1 | 8/2006 | Fick et al. |
| 2011/0036109 | A1 | 2/2011 | Krause et al. |
| 2011/0036782 | A1 | 2/2011 | Dileo |
| 2011/0062060 | A1 | 3/2011 | Royal et al. |
| 2012/0297817 | A1 | 11/2012 | Krause et al. |
| 2013/0008838 | A1 | 1/2013 | Burke et al. |

FOREIGN PATENT DOCUMENTS

| | | | |
|---|---|---|---|
| KR | 20120120844 | A | 11/2012 |
| WO | WO 83/02523 | | 7/1983 |
| WO | WO 97/38272 | | 10/1997 |
| WO | WO 03/011426 | | 2/2003 |
| WO | WO 03/084875 | | 10/2003 |
| WO | WO 2004/037383 | A1 | 5/2004 |
| WO | WO 2008/125530 | | 10/2008 |

* cited by examiner

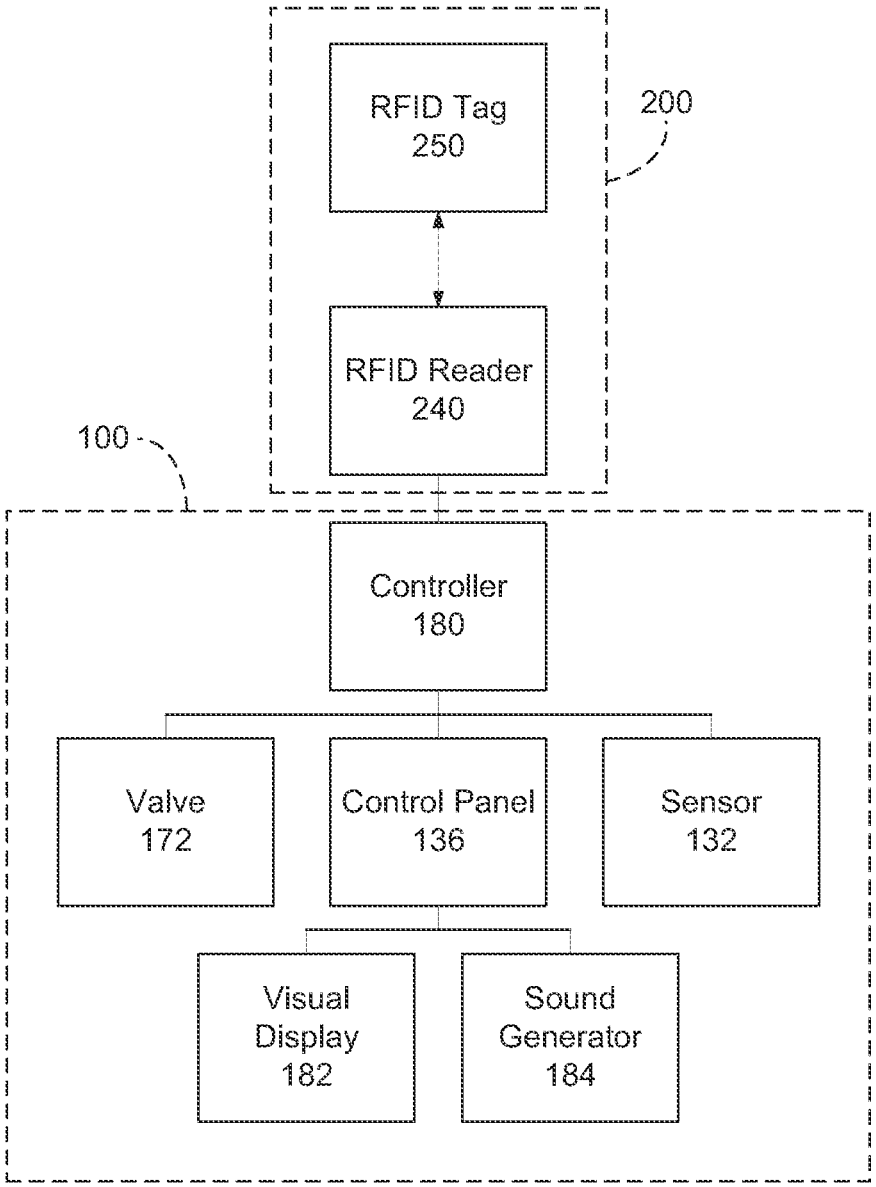
FIG. —6—

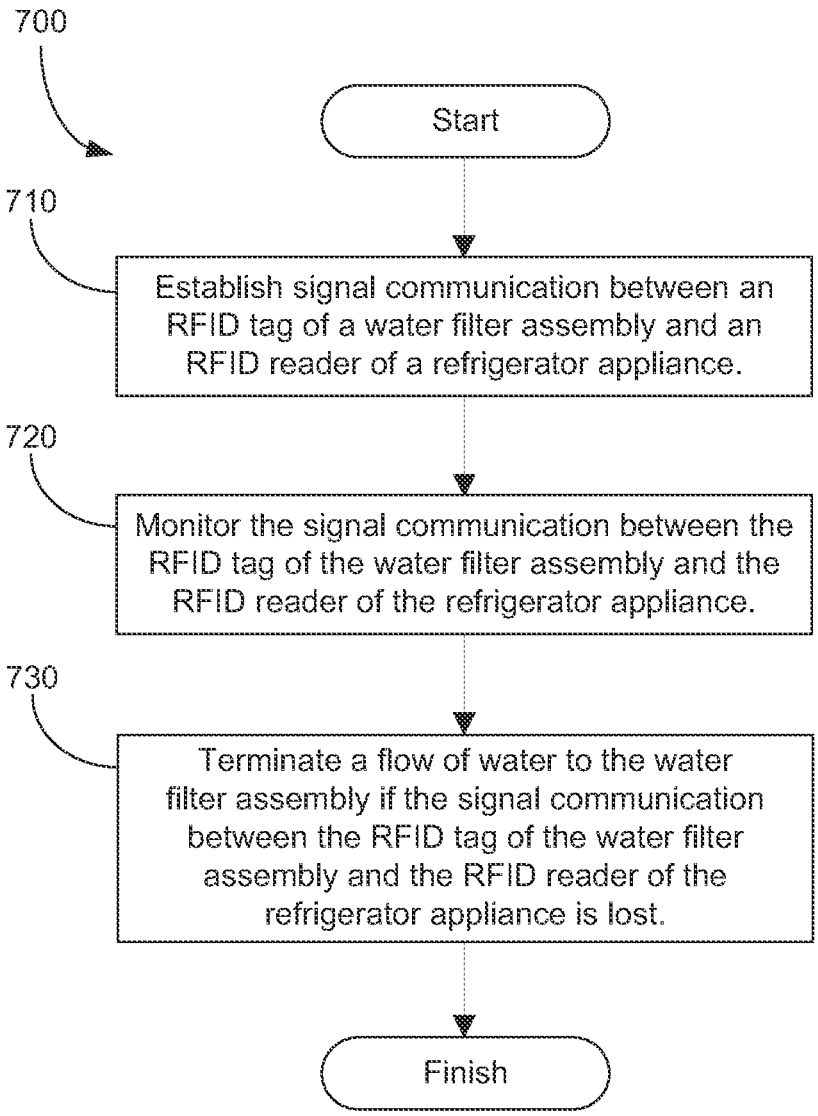
FIG. –7–

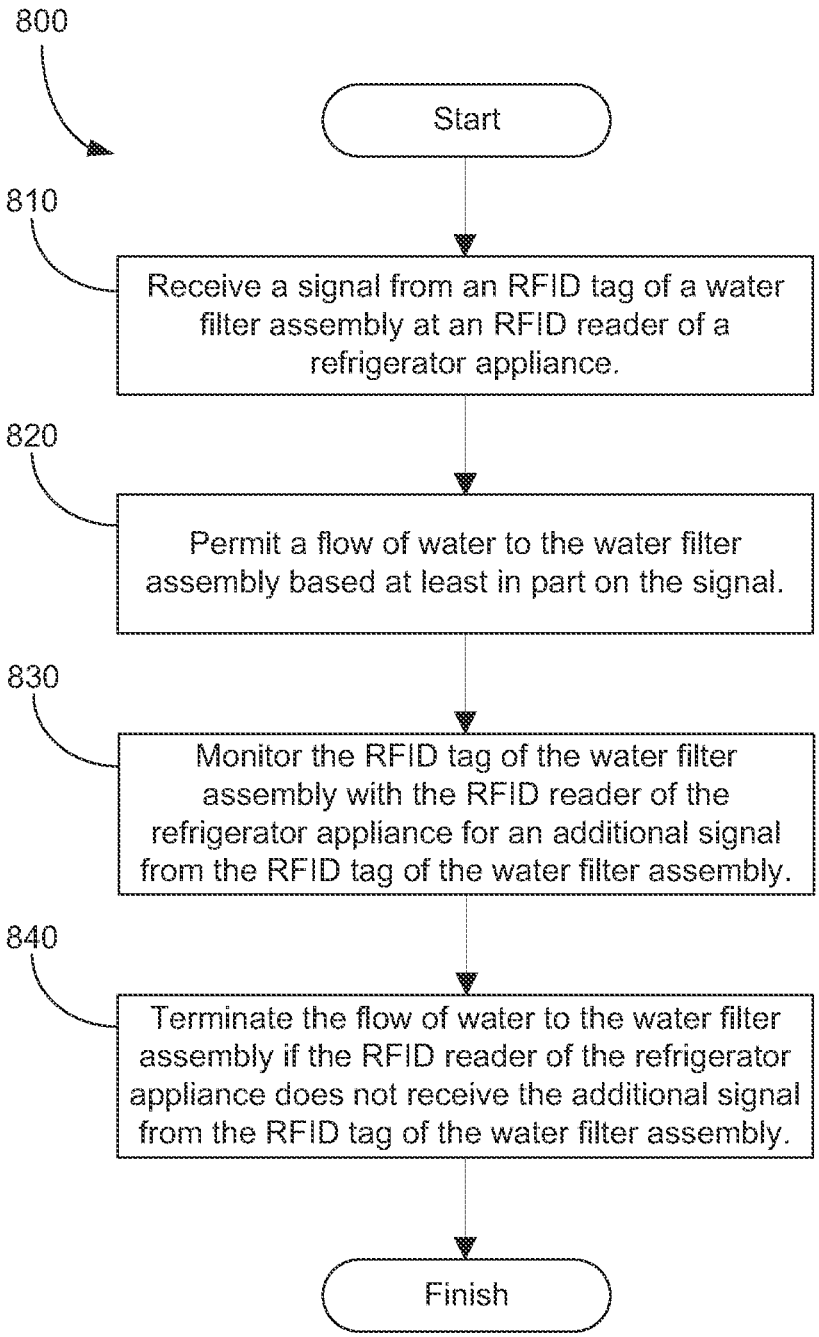
FIG. –8–

REFRIGERATOR APPLIANCE AND A METHOD FOR MONITORING A WATER FILTER ASSEMBLY WITHIN THE SAME

FIELD OF THE INVENTION

The present subject matter relates generally to refrigerator appliances and water filter assemblies for the same.

BACKGROUND OF THE INVENTION

Certain refrigerator appliances include water filter assemblies for filtering water. Water filter assemblies can filter water entering the refrigerator appliances in order to provide filtered water to various refrigerator appliance components, such as an ice maker and/or a water dispenser. Such filtering can improve a taste and/or an appearance of water within the refrigerator appliances.

Certain water filter assemblies include a manifold and a filter cartridge. The manifold is mounted to a cabinet of the refrigerator appliance and directs unfiltered water into the filter cartridge and filtered water out of the filter cartridge. The filter cartridge includes a filter media, such as an activated carbon block, a pleated polymer sheet, a spun cord material, or a melt blown material. The filter media is positioned within the filter cartridge and filters water passing therethrough.

Over time, the filter media will lose effectiveness. For example, pores of the filter media can become clogged or the filter media can become saturated with contaminants. To insure that the filtering media has not exceeded its filtering capacity, the filtering media is preferably replaced or serviced at regular intervals regardless of its current performance. To permit replacement or servicing of the filter media or the filter cartridge, the filter cartridge is generally removably mounted to the manifold.

Water leaks can form or develop at an interface or connection between the filter cartridge and the manifold, such as where the filter cartridge mounts to the manifold. As an example, such leaks can develop if the water filter assembly is installed incorrectly or exposed to relatively high water pressures or freezing conditions. Such leaks can negatively affect operation of the water filter assembly and/or the refrigerator appliance and can cause damage if not prevented. Such leaks can also be difficult to detect. In particular, water filter assemblies are often positioned in relatively remote locations within refrigerator appliances such that visually monitoring the water filter assemblies for leaks can be difficult or infrequent.

Accordingly, a method for monitoring a water filter assembly within a refrigerator appliance for water leaks would be useful. In particular, a method for monitoring a water filter assembly within a refrigerator appliance for water leaks that does not require visual observation of the water filter assembly and/or that notifies a user of the refrigerator appliance of water leaks would be useful.

BRIEF DESCRIPTION OF THE INVENTION

The present subject matter provides a refrigerator appliance and a method for monitoring a water filter assembly within the same. The method includes monitoring signal communication between an RFID tag of the water filter assembly and an RFID reader of the refrigerator appliance and terminating a flow of water to the water filter assembly if the signal communication between the RFID tag of the water filter assembly and the RFID reader of the refrigerator appliance is lost or disrupted. Additional aspects and advantages of the invention will be set forth in part in the following description, or may be apparent from the description, or may be learned through practice of the invention.

In a first exemplary embodiment, a method for monitoring a water filter assembly within a refrigerator appliance is provided. The water filter assembly has an RFID tag mounted to a filter cartridge of the water filter assembly. The refrigerator appliance has an RFID reader mounted proximate the RFID tag of the water filter assembly. The method includes receiving a signal from the RFID tag of the water filter assembly at the RFID reader of the refrigerator appliance, permitting a flow of water to the water filter assembly based at least in part on the signal of the step of receiving, monitoring, during the step of permitting, the RFID tag of the water filter assembly with the RFID reader of the refrigerator appliance for an additional signal from the RFID tag of the water filter assembly, and terminating the flow of water to the water filter assembly if the RFID reader of the refrigerator appliance does not receive the additional signal from the RFID tag of the water filter assembly during the step of monitoring.

In a second exemplary embodiment, a method for monitoring a water filter assembly within a refrigerator appliance is provided. The water filter assembly has an RFID tag mounted to a filter cartridge of the water filter assembly. The refrigerator appliance has an RFID reader positioned proximate the RFID tag of the water filter assembly. The method includes establishing signal communication between the RFID tag of the water filter assembly and the RFID reader of the refrigerator appliance, monitoring the signal communication between the RFID tag of the water filter assembly and the RFID reader of the refrigerator appliance, and terminating a flow of water to the water filter assembly if the signal communication between the RFID tag of the water filter assembly and the RFID reader of the refrigerator appliance is lost during the step of monitoring.

In a third exemplary embodiment, a refrigerator appliance is provided. The refrigerator appliance includes a cabinet that defines a chilled chamber for receipt of food articles for storage. A water filter assembly is mounted to the cabinet. The water filter assembly includes a manifold that defines an inlet for receiving unfiltered water and an outlet for directing filtered water out of the water filter assembly. A filter cartridge is mounted to the manifold. The cartridge has a filtering media positioned therein for filtering a flow of water through the water filter assembly. An RFID tag is mounted to the filter cartridge. An RFID reader is mounted to the cabinet. The RFID reader is positioned proximate the RFID tag of the water filter assembly. A controller is in communication with RFID reader. The controller is configured for establishing signal communication between the RFID tag of the water filter assembly and the RFID reader, monitoring the signal communication between the RFID tag of the water filter assembly and the RFID reader, and terminating a flow of water to the water filter assembly if the signal communication between the RFID tag of the water filter assembly and the RFID reader is lost during the step of monitoring.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

FIG. 6 provides a schematic view of certain components of the exemplary refrigerator appliance of FIG. 1 and certain components of the exemplary water filter assembly of FIG. 3.

FIG. 7 illustrates a method for monitoring a water filter assembly within a refrigerator appliance according to an exemplary embodiment of the present subject matter.

FIG. 8 illustrates a method for monitoring a water filter assembly within a refrigerator appliance according to another exemplary embodiment of the present subject matter.

DETAILED DESCRIPTION

Figure 1:
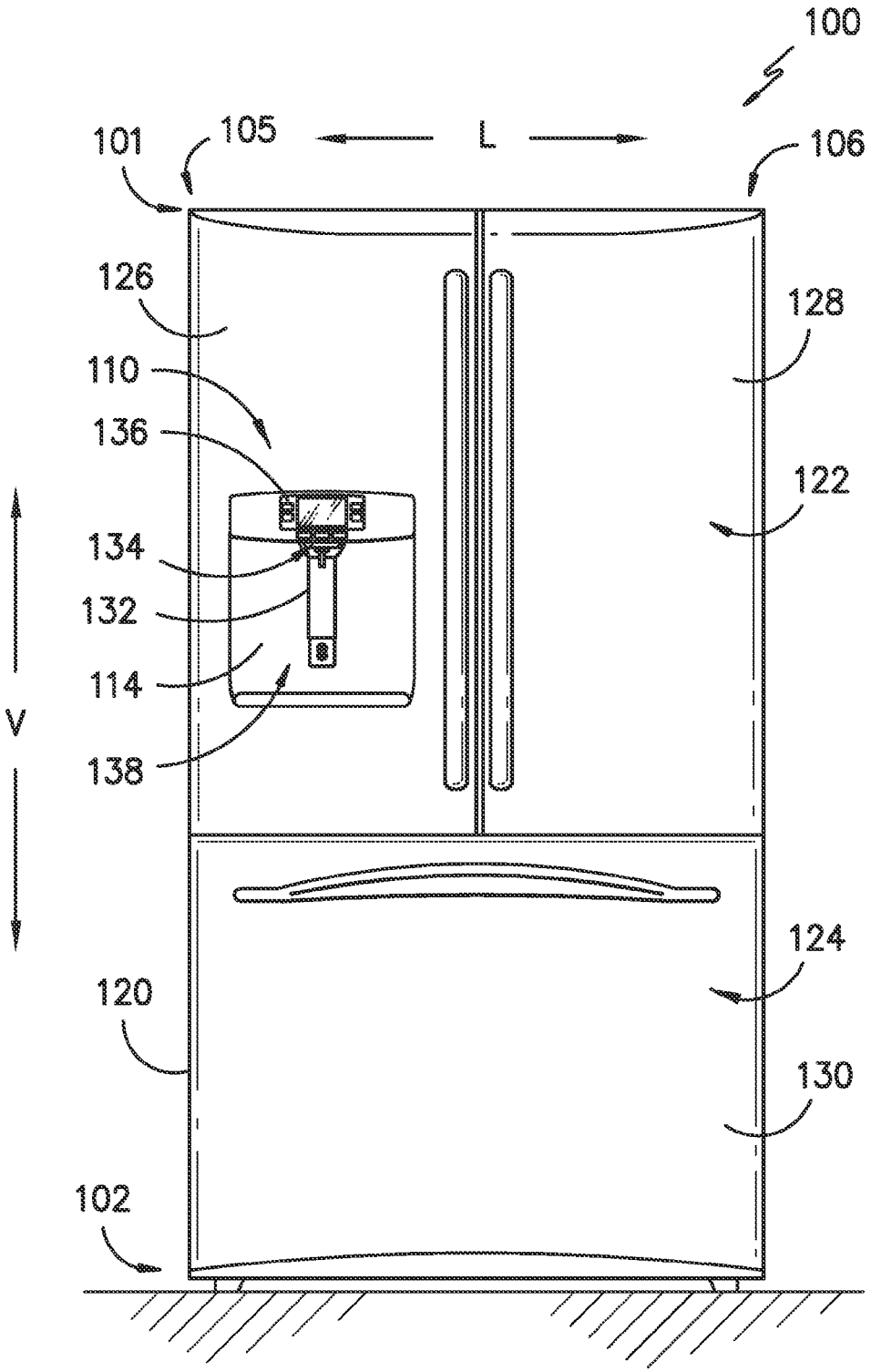
FIG. 1 provides a front, elevation view of a refrigerator appliance according to an exemplary embodiment of the present subject matter with refrigerator doors of the refrigerator appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
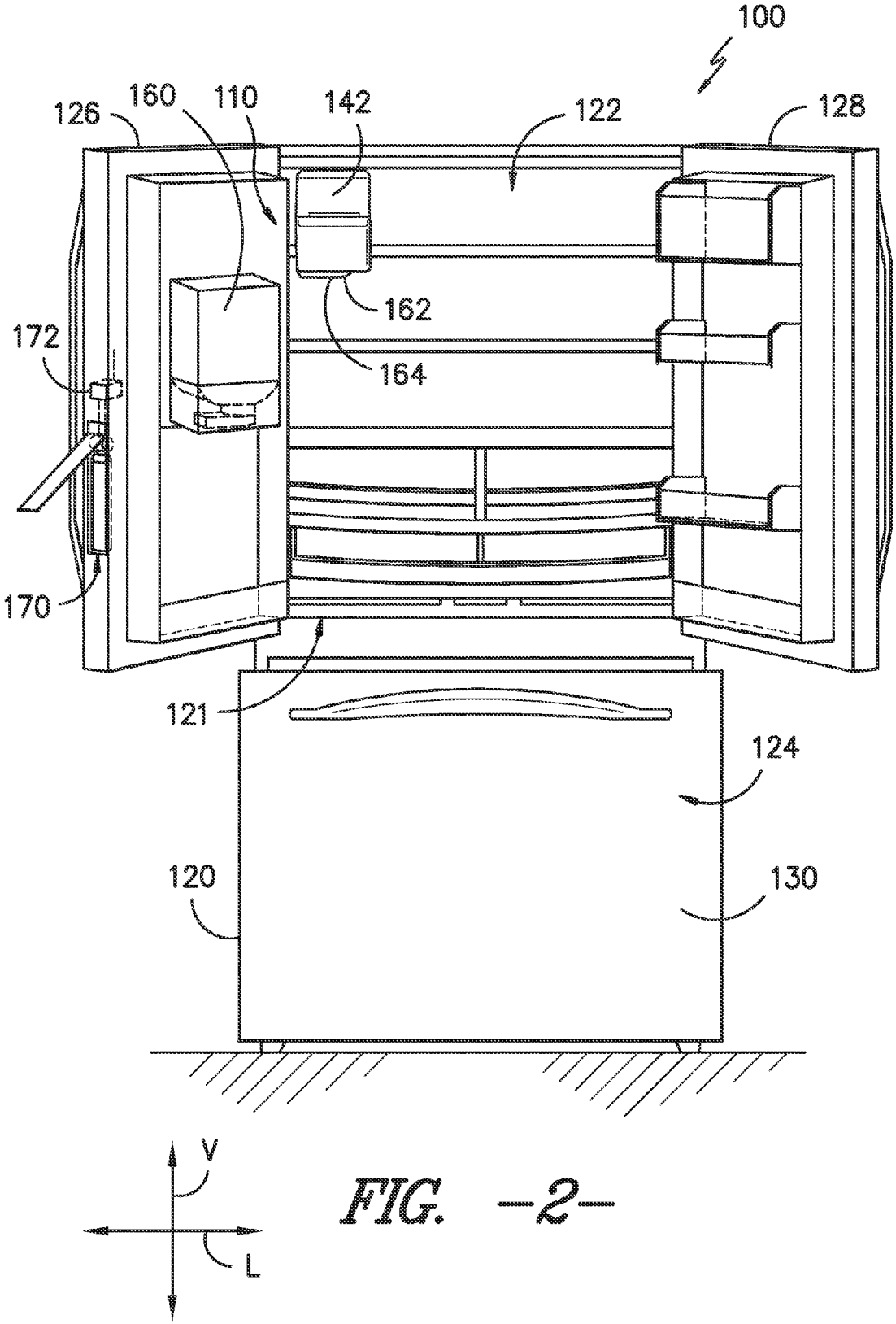
FIG. 2 provides a front, elevation view of the exemplary refrigerator appliance of FIG. 1 with refrigerator doors of the refrigerator appliance shown in an open position.

FIG. 1 provides a front, elevation view of a refrigerator appliance 100 according to an exemplary embodiment of the present subject matter. FIG. 2 provides a front, elevation view of refrigerator appliance 100 with refrigerator doors 126 and 128 of refrigerator appliance 100 shown in an open position to reveal a fresh food chamber 122 of refrigerator appliance 100. Refrigerator appliance 100 defines a vertical direction V, a transverse direction T (FIG. 3), and a lateral direction L. The vertical direction V, transverse direction T, and lateral direction L are mutually perpendicular and form an orthogonal direction system. Refrigerator appliance 100 extends between an upper portion 101 and a lower portion 102 along the vertical direction V. Refrigerator appliance 100 also extends between a first side portion 105 and a second side portion 106 along the lateral direction L.

Refrigerator appliance 100 includes a cabinet or housing 120 that defines chilled chambers for receipt of food items for storage. In particular, refrigerator appliance 100 defines fresh food chamber 122 at upper portion 101 of refrigerator appliance 100 and a freezer chamber 124 arranged below fresh food chamber 122 on the vertical direction V, e.g., at lower portion 102 of refrigerator appliance 100. As such, refrigerator appliance 100 is generally referred to as a bottom mount refrigerator appliance. However, using the teachings disclosed herein, one of skill in the art will understand that the present subject matter may be used with other types of refrigerator appliances (e.g., side-by-side style or top mount style) or a freezer appliance as well. Consequently, the description set forth herein is for illustrative purposes only and is not intended to limit the present subject matter in any aspect.

Refrigerator doors 126 and 128 are rotatably hinged to an edge of housing 120 for accessing fresh food chamber 122. In particular, housing 120 defines an opening 121. Opening 121 of housing 120 permits access to fresh food chamber 122 of housing 120. Refrigerator doors 126 and 128 are positioned at opening 121 of housing 120 and permit selective access to fresh food chamber 122 of housing 120 through opening 121 of housing 120, e.g., by rotating between the open and closed positions. A freezer door 130 is arranged below refrigerator doors 126 and 128 for accessing freezer chamber 124. Freezer door 130 is coupled to a freezer drawer (not shown) slidably mounted within freezer chamber 124.

Refrigerator appliance 100 also includes a dispensing assembly 110 for dispensing water and/or ice. Dispensing assembly 110 includes a dispenser 114 positioned on or mounted to an exterior portion of refrigerator appliance 100, e.g., on refrigerator door 126. Dispenser 114 includes a discharging outlet 134 for accessing ice and water. A sensor 132, such as an ultrasonic sensor, is mounted below discharging outlet 134 for operating dispenser 114. In alternative exemplary embodiments, any suitable actuator may be used to operate dispenser 114. For example, dispenser 114 can include a paddle or button rather than sensor 132. A user interface panel 136 is provided for controlling the mode of operation. For example, user interface panel 136 includes a water dispensing button (not labeled) and an ice-dispensing button (not labeled) for selecting a desired mode of operation such as crushed or non-crushed ice.

Discharging outlet 134 and sensor 132 are an external part of dispenser 114 and are mounted in a dispenser recess 138 defined in an outside surface of refrigerator door 126. Dispenser recess 138 is positioned at a predetermined elevation convenient for a user to access ice or water and enabling the user to access ice without the need to bend-over and without the need to access freezer chamber 124. In the exemplary embodiment, dispenser recess 138 is positioned at a level that approximates the chest level of a user.

Turning now to FIG. 2, certain components of dispensing assembly 110 are illustrated. Dispensing assembly 110 includes an insulated housing 142 mounted within fresh food chamber 122. Due to the insulation which encloses insulated housing 142, the temperature within insulated housing 142 can be maintained at levels different from the ambient temperature in the surrounding fresh food chamber 122.

Insulated housing 142 is constructed and arranged to operate at a temperature that facilitates producing and storing ice. More particularly, insulated housing 142 contains an ice maker (not shown) for creating ice and feeding the same to a container 160 that is mounted on refrigerator door 126. As illustrated in FIG. 2, container 160 is placed at a vertical position on refrigerator door 126 that will allow for the receipt of ice from a discharge opening 162 located along a bottom edge 164 of insulated housing 142. As refrigerator door 126 is closed or opened, container 160 is moved in and out of position under insulated housing 142.

Refrigerator appliance 100 also includes a water filter assembly 170. Water filter assembly 170 can filter water from a water supply (not shown), such as a municipal water source or a well. Water filter assembly 170 can remove contaminants and other undesirable substances from water passing therethrough. As will be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

Water filter assembly 170 is mounted to housing 120. In particular, water filter assembly 170 is mounted to refrigerator door 126 in the exemplary embodiment shown in FIG. 2. However, it should be understood that water filter assembly 170 can be positioned at any other suitable location within refrigerator appliance 100 in alternative exemplary embodiments. For example, water filter assembly 170 may be mounted to refrigerator door 128, to housing 120 within fresh food chamber 122, or to housing 120 below freezer chamber 124 in alternative exemplary embodiments. Thus, the position of water filter assembly 170 shown in FIG. 2 is not intended to limit the present subject matter in any aspect and is provided by way of example only.

Refrigerator appliance 100 also includes a valve 172 as schematically shown in FIG. 2. Valve 172 is configured for regulating a flow of water to water filter assembly 170. In particular, valve 172 can selectively shift between a closed position and an open position. Valve 172 permits the flow of water to water filter assembly 170 in the open position. Thus, with valve 172 in the open position, water for filtering is supplied to water filter assembly 170. Conversely, valve 172 obstructs or blocks the flow of water to water filter assembly 170 in the closed position. Thus, with valve 172 in the closed position, water for filtering is not supplied to water filter assembly 170 or is supplied to water filter assembly 170 in an insubstantial volume. In such a manner, valve 172 can regulate the flow of water to water filter assembly 170 by shifting between the open and closed positions.

Figure 3:
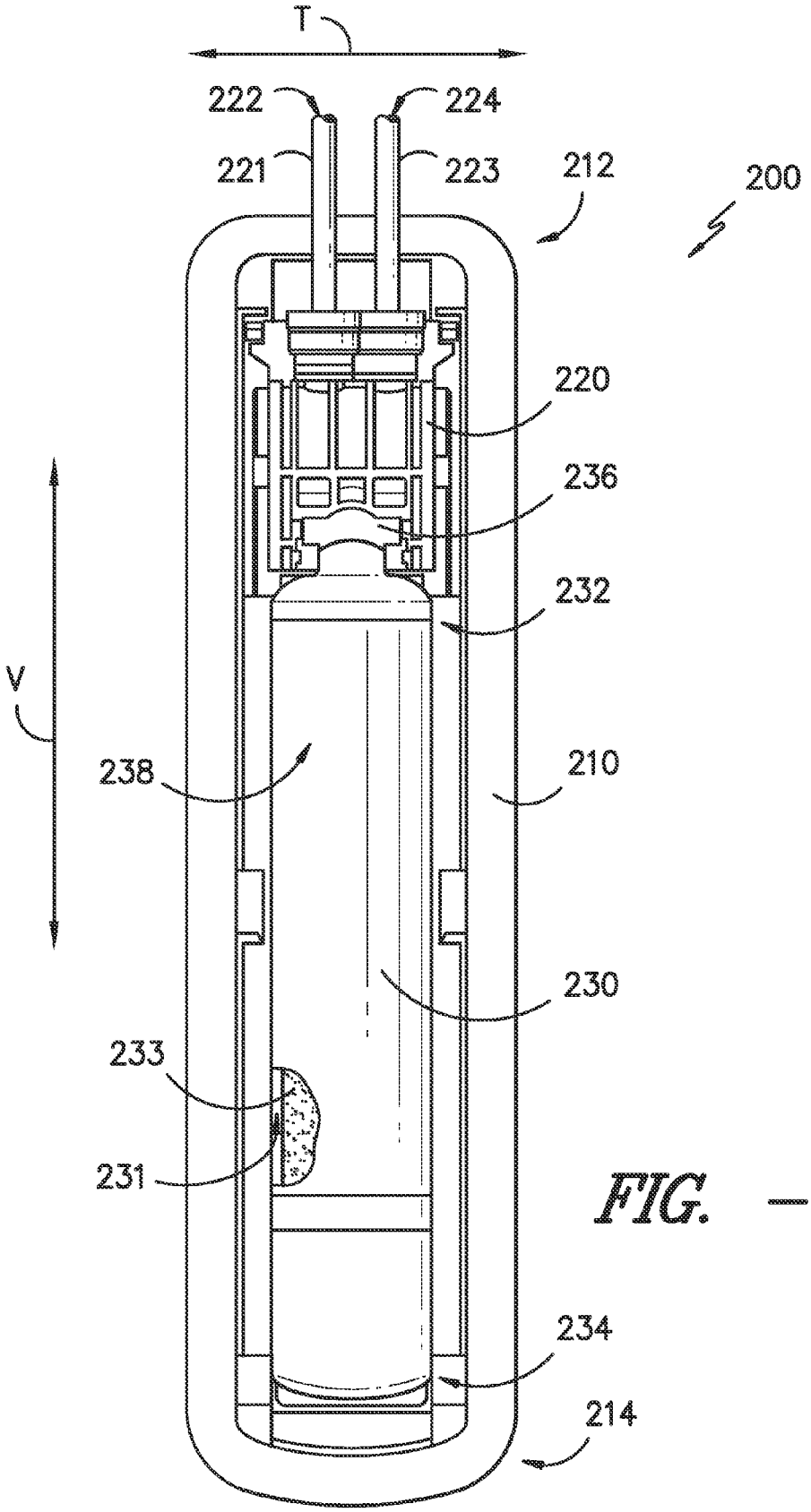
FIG. 3 provides a front, elevation view of a water filter assembly according to an exemplary embodiment of the present subject matter.
Figure 4:
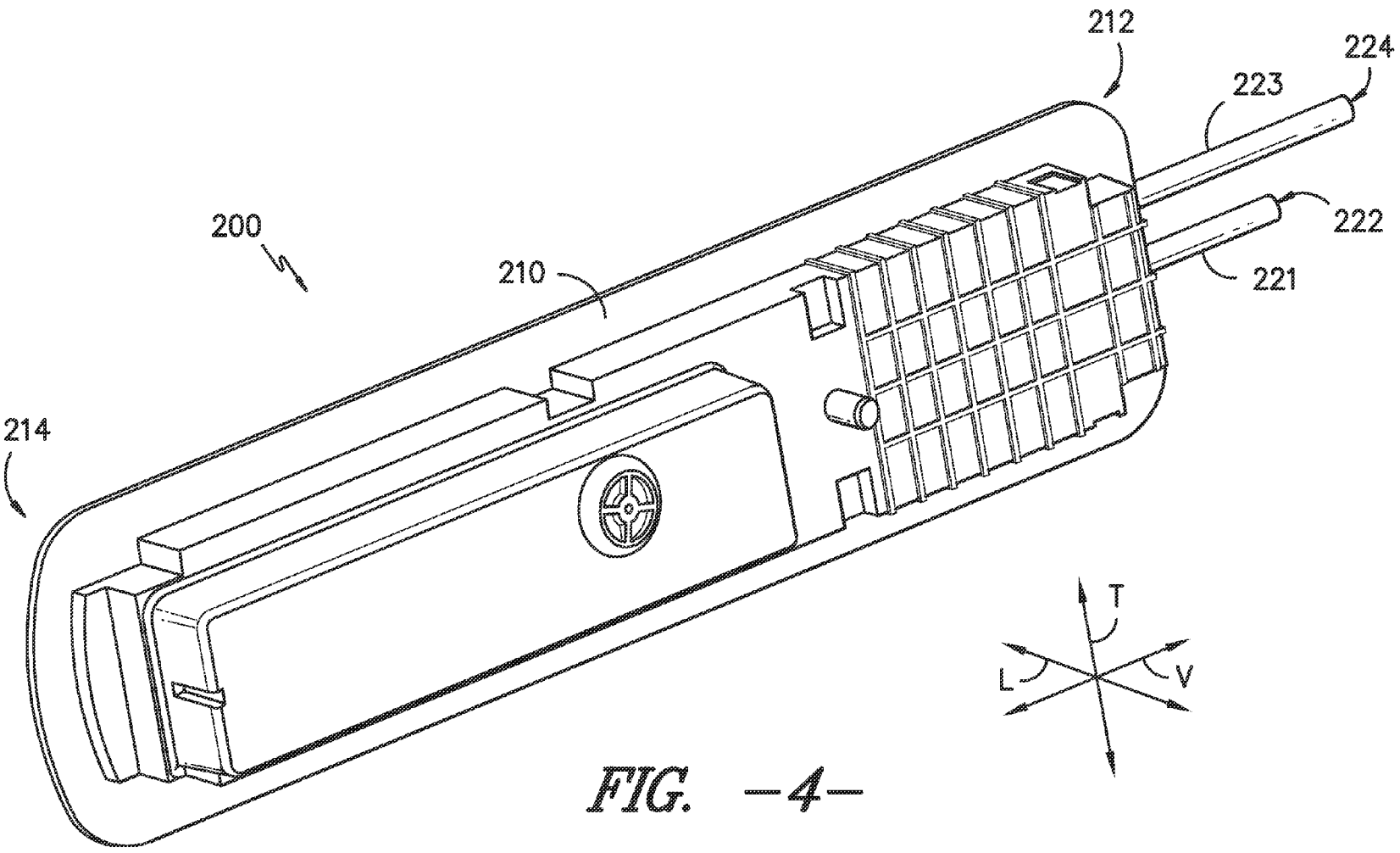
FIG. 4 provides a rear, perspective view of the exemplary water filter assembly of FIG. 3.

FIG. 3 provides a front, elevation view of a water filter assembly 200 according to an exemplary embodiment of the present subject matter. FIG. 4 provides a rear, perspective view of water filter assembly 200. Water filter assembly 200 can be used in any suitable refrigerator appliance. For example, water filter assembly 200 may be used in refrigerator appliance 100 (FIG. 2) as water filter assembly 170 (FIG. 2). As discussed in greater detail below, water filter assembly 200 is configured for filtering water passing therethrough. In such a manner, water filter assembly 200 can provide filtered water to various components of refrigerator appliance 100, such as dispensing assembly 110 or the ice maker (not shown) within insulated housing 142.

As may be seen in FIG. 3, water filter assembly 200 includes a casing 210. Casing 210 extends between a top portion 212 and a bottom portion 214, e.g., along the vertical direction V. Casing 210 can be mounted to any suitable portion of refrigerator appliance 100 in order to mount water filter assembly 200 to refrigerator appliance 100. For example, casing 210 may be mounted to refrigerator door 126 or housing 120. In particular, casing 210 may be encased within or engage insulating foam (not shown) of housing 120 to mount water filter assembly 200 to refrigerator appliance 100.

Water filter assembly 200 also includes a manifold 220. Manifold 220 is mounted to casing 210, e.g., at or proximate top portion 212 of casing 210. Manifold 220 is configured for receiving unfiltered water and directing filtered water out of water filter assembly 200. In particular, manifold 220 includes an inlet conduit 221 that defines an inlet 222. Inlet 222 receives unfiltered water, e.g., from a water source (not shown) such as a municipal water supply or a well. Manifold 220 also includes an outlet conduit 223 that defines an outlet 224. Outlet 224 directs filtered water out of water filter assembly 200. Thus, manifold 220 receives unfiltered water at inlet 222. Such unfiltered water passes through water filter assembly 200 and exits manifold 220 at outlet 224 as filtered water.

As shown in FIG. 3, water filter assembly 200 includes a filter canister or filter cartridge 230 for filtering unfiltered water received at inlet 222 of manifold 220. Thus, filter cartridge 230 filters water passing through water filter assembly 200. Filter cartridge 230 extends between a top portion 232 and a bottom portion 234, e.g., along the vertical direction V. A connection 236 of filter cartridge 230 is positioned at or proximate top portion 232 of filter cartridge 230. Connection 236 of filter cartridge 230 is configured for engaging manifold 220, e.g., in order to removably mount filter cartridge 230 to manifold 220.

Connection 236 of filter cartridge 230 also places filter cartridge 230 in fluid communication with manifold 220 when filter cartridge 230 is mounted to manifold 220. Thus, filter cartridge 230 can receive unfiltered water from inlet 222 of manifold 220 at connection 236 and direct such unfiltered water into a chamber 231 when filter cartridge 230 is mounted to manifold 220. Water within chamber 231 can pass through a filtering media 233 positioned within chamber 231 and can exit chamber 231 as filtered water. In particular, connection 236 of filter cartridge 230 can direct filtered water out of chamber 231 to outlet 224 of manifold 220 when filter cartridge 230 is mounted to manifold 220. In such a manner, filtering media 233 of filter cartridge 230 can filter a flow of water through water filter assembly 200. Such filtering can improve taste and/or safety of water.

Filtering media 233 can include any suitable mechanism for filtering water within water filter assembly 200. For example, filtering media 233 may include an activated carbon block, a reverse osmosis membrane, a pleated polymer or cellulose sheet, or a melt blown or spun cord media. As used herein, the term "unfiltered" describes water that is not filtered relative to filtering media 233. However, as will be understood by those skilled in the art, water filter assembly 200 may include additional filters that filter water entering chamber 231. Thus, "unfiltered" may be filtered relative to other filters but not filtering media 233.

As will be understood by those skilled in the art, filtering media 233 of filter cartridge 230 can lose efficacy over time. Thus, a user can replace filtering cartridge and/or filtering media 233 of filter cartridge 230 at regular intervals or after a certain volume of water has passed through filter cartridge 230. To replace filtering cartridge and/or filtering media 233 of filter cartridge 230, the user can remove or disconnect filter cartridge 230 from manifold 220 and insert or mount a new filter cartridge 230 or filtering media 233 of filter cartridge 230.

Water filter assembly 200 can be exposed to a variety of conditions within that can negatively affect performance of water filter assembly 200. For example, high water pressure at inlet 222 of manifold and/or connection 236 of filter cartridge 230 or exposing water filter assembly 200 to freezing conditions can negatively affect performance of water filter assembly 200. Such conditions can cause water filter assembly 200 to leak, e.g., at connection 236 of filter cartridge 230. Such conditions can also cause water filter assembly 200 to deform or crack. As discussed in greater detail below, water filter assembly 200 includes features for detecting such malfunctions of water filter assembly 200.

Figure 5:
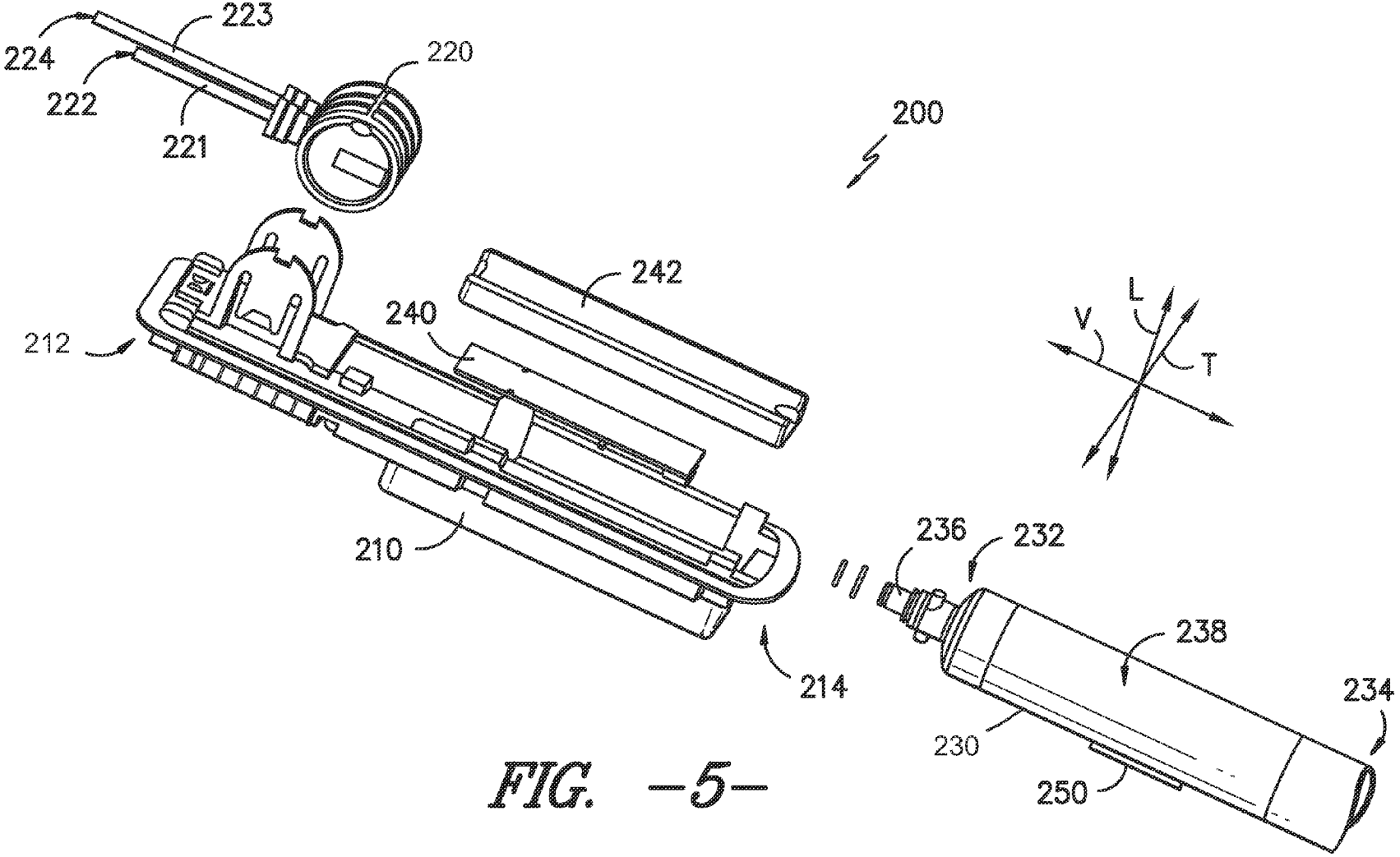
FIG. 5 provides an exploded view of the exemplary water filter assembly of FIG. 3.

FIG. 5 provides an exploded view of water filter assembly 200. As may be seen in FIG. 5, water filter assembly 200 includes a radio frequency identification tag or RFID tag 250. RFID tag 250 is mounted to filter cartridge 230. In particular, RFID tag 250 is positioned at or on an outer surface 238 of filter cartridge 230. Water filter assembly 200 also includes a radio frequency identification reader or RFID reader 240. RFID reader 240 is mounted to casing 210 and protected behind a cover 242. RFID reader 240 is also positioned proximate RFID tag 250.

RFID reader 240 is configured for receiving a signal from RFID tag 250. Thus, RFID reader 240 and RFID tag 250 can be in signal communication with each other. As an example, RFID tag 250 may be a passive RFID tag. Thus, RFID reader 240 can receive a radio signal from RFID tag 250 in response to a query or request signal from RFID reader 250. In particular, RFID tag 250 can generate or transmit the response radio signal utilizing energy transmitted, e.g., wirelessly, to RFID tag 250 from RFID reader 240 via the query or request signal from RFID reader 240. Thus, RFID tag 250 need not include a battery or other power source in order to generate or transmit the response radio signal. As another example, RFID tag 250 can include a battery or be connected to a suitable power source, and RFID tag 250 can continuously or intermittently generate or transmit a signal that RFID reader 240 can receive. As will be understood, RFID reader 240 and RFID tag 250 can have any other suitable setup or configuration for placing RFID reader 240 and RFID tag 250 in signal communication with each other. Thus, RFID reader 240 may be passive or active, and RFID tag 250 may be passive or active depending upon the desired setup of water filter assembly 200.

As will be understood by those skilled in the art, signal communication between RFID reader 240 and RFID tag 250 is affected by a variety of factors. For example, RFID reader 240 and RFID tag 250 are separated by a particular distance within water filter assembly 200. Signal communication between RFID reader 240 and RFID tag 250 can be limited or terminated if the distance between RFID reader 240 and RFID tag 250 is increased. Similarly, signal communication between RFID reader 240 and RFID tag 250 is stronger when RFID reader 240 and RFID tag 250 face each other rather than being perpendicularly oriented to each other. Thus, if an orientation between an antenna (not shown) of RFID reader 240 and an antenna (not shown) of RFID tag 250 is adjusted or changed, signal communication between RFID reader 240 and RFID tag 250 can be limited or terminated.

RFID reader 240 and RFID tag 250 can also be tuned such that signal communication between RFID reader 240 and RFID tag 250 is established with a particular transmission media, such as air, disposed between RFID reader 240 and RFID tag 250. Thus, signal communication between RFID reader 240 and RFID tag 250 can be terminated if the transmission media changes and another material is positioned between RFID reader 240 and RFID tag 250. For example, if water or a solid object positioned between RFID reader 240 and RFID tag 250, signal communication between RFID reader 240 and RFID tag 250 can be terminated or disrupted. In particular, liquids, such as water, can absorb radio waves and thereby terminate or disrupt signal communication between RFID reader 240 and RFID tag 250. Similarly, solids, such as a metal, can shield or reflect radio waves and thereby terminate or disrupt signal communication between RFID reader 240 and RFID tag 250. As described in greater detail below, when signal communication between RFID reader 240 and RFID tag 250 is lost or terminated, water filter assembly 200 may be malfunctioning, e.g., may be leaking.

FIG. 6 provides a schematic view of certain components of refrigerator appliance 100 and certain components of water filter assembly 200. Operation of the refrigerator appliance 100 and water filter assembly 200 can be regulated by a controller 180 that is operatively coupled to various components of refrigerator appliance 100 and water filter assembly 200, such as user interface panel 136, sensor 132, valve 172, RFID reader 240, etc. For example, in response to user manipulation of user interface panel 136, controller 180 operates various components of the refrigerator appliance 100 and water filter assembly 200.

Controller 180 may include a memory and one or more microprocessors, CPUs or the like, such as general or special purpose microprocessors operable to execute programming instructions or micro-control code associated with operation of refrigerator appliance 100 and water filter assembly 200. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 180 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 180 may be positioned in a variety of locations throughout refrigerator appliance 100. In the illustrated exemplary embodiment of FIG. 1, controller 180 may be located within the control panel area of refrigerator door 126. In such an embodiment, input/output ("I/O") signals may be routed between controller 180 and various operational components of refrigerator appliance 100 and water filter assembly 200. User interface panel 136 may be in communication with controller 180 via one or more signal lines or shared communication busses.

As discussed above, controller 180 is in communication with RFID reader 240. Controller 180 is configured for establishing signal communication between RFID tag 250 and RFID reader 240. For example, controller 180 can activate RFID reader 240 such that RFID reader 240 queries RFID tag 250 by sending a request signal to RFID tag 250. In response to the request signal, RFID tag 250 can generate or transmit a response signal that is received at RFID reader 240. In such a manner, controller 180 can establish signal communication between RFID reader 240 and RFID tag 250.

Controller 180 is also configured for monitoring the signal communication between RFID tag 250 and RFID reader 240. For example, controller 180 can continuously or intermittently operate RFID reader 240 such that RFID reader 240 queries RFID tag 250 by sending a request signal to RFID tag 250. If RFID tag 250 receives the request signal from RFID reader 240, RFID tag 250 can generate or transmit a response signal that is received at RFID reader 240 in response to the request signal. If RFID reader 240 receives the response signal from RFID tag 250, controller 180 can determine that RFID reader 240 and RFID tag 250 are in signal communication with each other. Conversely, if RFID reader 240 does not receive the response signal from RFID tag 250, controller 180 can determine that RFID reader 240 and RFID tag 250 are not in signal communication with each other. In such a manner, controller 180 can monitor the signal communication between RFID tag 250 and RFID reader 240.

Controller 180 is further configured for terminating a flow of water to water filter assembly 200 if the signal communication between RFID tag 250 and RFID reader 240 is lost or disrupted. Thus, controller 180 can, e.g., continuously or intermittently, monitor the signal communication between RFID tag 250 and RFID reader 240, and controller 180 can terminate the flow of water to water filter assembly 200 if the signal communication between RFID tag 250 and RFID reader 240 is lost or disrupted. For example, if water leaks from water filter assembly 200, e.g., at connection 236, and flows between RFID tag 250 and RFID reader 240, signal communication between RFID tag 250 and RFID reader 240 can be disrupted or lost. As another example, if water within filter cartridge 230 freezes and expands, filter cartridge 230 can deform or crack such that a position of RFID tag 250 relative to RFID reader 240 changes, and signal communication between RFID tag 250 and RFID reader 240 can be disrupted or lost.

Thus, if signal communication between RFID tag 250 and RFID reader 240 is lost or disrupted, it can be inferred that water filtering assembly 200 is malfunctioning, e.g., leaking or frozen. As discussed above, controller 180 is in communication with valve 172. In response to the loss of signal communication between RFID tag 250 and RFID reader 240, controller 180 can adjust valve 172 to the closed position in order to terminate the flow of water to water filter assembly 200. Thus, if water filter assembly 200 is leaking and signal communication between RFID tag 250 and RFID reader 240 is lost or disrupted, controller 180 can terminate the flow of water to water filter assembly 200.

As may be seen in FIG. 5, refrigerator appliance 100 also includes a visual display 182. Visual display 182 is configured for generating a visual indicator that water filter assembly 200 is malfunctioning. Visual display 182 can be any suitable mechanism for providing visual feedback to a user of refrigerator appliance 100 that water filter assembly 200 is malfunctioning. As an example, visual display 182 may be a light emitting diode or bulb that flashes or otherwise emits light when signal communication between RFID tag 250 and RFID reader 240 is lost or disrupted. As another example, visual display 182 may be a liquid crystal display or plasma screen that displays a message thereon when signal communication between RFID tag 250 and RFID reader 240 is lost or disrupted. Controller 180 is in communication with visual display 182 and can selectively activate visual display 182 in order to notify a user of refrigerator appliance 100 that water filter assembly 200 is malfunctioning.

Refrigerator appliance 100 further includes a sound generator 184. Sound generator 184 is configured for generating an audio indicator that water filter assembly 200 is malfunctioning. Sound generator 184 can be any suitable mechanism for providing audio feedback to a user of refrigerator appliance 100 that water filter assembly 200 is malfunctioning. As an example, sound generator 184 may be a speaker that emits sound when signal communication between RFID tag 250 and RFID reader 240 is lost or disrupted. Controller 180 is in communication with sound generator 184 and can selectively activate sound generator 184 in order to notify a user of refrigerator appliance 100 that water filter assembly 200 is malfunctioning.

Visual display 182 and sound generator 184 may be positioned at any suitable location on refrigerator appliance 100. For example, visual display 182 and sound generator 184 can be mounted to housing 120 (FIG. 1) of refrigerator appliance 100, e.g., at user interface panel 136 of refrigerator appliance 100 above dispenser recess 138. It should be understood that refrigerator appliance 100 need not include both visual display 182 and sound generator 184 and may include only visual display 182 or sound generator 184.

FIG. 7 illustrates a method 700 for monitoring a water filter assembly within a refrigerator appliance according to an exemplary embodiment of the present subject matter. Method 700 can be used to monitor any suitable water filter assembly within any suitable refrigerator appliance. For example, method 700 may be used to monitor water filter assembly 200 (FIG. 3) within refrigerator appliance 100 (FIG. 1). In particular, controller 180 may be configured for implementing method 700.

At step 710, controller 180 establishes signal communication between RFID tag 250 and RFID reader 240. For example, controller 180 can activate RFID reader 240 such that RFID reader 240 queries RFID tag 250 by sending a request signal to RFID tag 250. In response to the request signal, RFID tag 250 can generate or transmit a response signal that is received at RFID reader 240. In such a manner, controller 180 can establish signal communication between RFID reader 240 and RFID tag 250.

At step 720, controller 180 monitors the signal communication between RFID tag 250 and RFID reader 240. For example, controller 180 can continuously or intermittently operate RFID reader 240 such that RFID reader 240 queries RFID tag 250 by sending a request signal to RFID tag 250. If RFID tag 250 receives the request signal from RFID reader 240, RFID tag 250 can generate or transmit a response signal that is received at RFID reader 240 in response to the request signal. If RFID reader 240 receives the response signal from RFID tag 250, controller 180 can determine that RFID reader 240 and RFID tag 250 are in signal communication with each other. Conversely, if RFID reader 240 does not receive the response signal from RFID tag 250, controller 180 can determine that RFID reader 240 and RFID tag 250 are not in signal communication with each other. In such a manner, controller 180 can monitor the signal communication between RFID tag 250 and RFID reader 240.

At step 730, controller 180 terminates a flow of water to water filter assembly 200 if the signal communication between RFID tag 250 and RFID reader 240 is lost or fails. For example, controller 180 can adjust or actuate valve 172 to the closed position in order to terminate the flow of water to water filter assembly 200 in response to the loss of signal communication between RFID tag 250 and RFID reader 240. Thus, if water filter assembly 200 is malfunctioning and signal communication between RFID tag 250 and RFID reader 240 is lost or disrupted, controller 180 can terminate the flow of water to water filter assembly 200.

Method 700 can also include initiating the flow of water to water filter assembly 200 after step 710. For example, controller 180 can adjust or actuate valve 172 to the open position in order to initiate the flow of water to water filter assembly 200 if signal communication between RFID tag 250 and RFID reader 240 is established at step 710.

Method 700 can further include notifying a user of refrigerator appliance 100 that water filter assembly 200 is malfunctioning if the signal communication between RFID tag 250 and RFID reader 240 is lost at step 730. For example, controller 180 can operate or activate at least one of visual display 182 and sound generator 184 in order to notify the user of refrigerator appliance 100 that water filter assembly 200 is malfunctioning.

FIG. 8 illustrates a method 800 for monitoring a water filter assembly within a refrigerator appliance according to another exemplary embodiment of the present subject matter. Method 800 can be used to monitor any suitable water filter assembly within any suitable refrigerator appliance. For example, method 800 may be used to monitor water filter assembly 200 (FIG. 3) within refrigerator appliance 100 (FIG. 1). In particular, controller 180 may be configured to implement method 800.

At step 810, controller 180 determines that RFID reader 240 has received a signal from RFID tag 250. For example, controller 180 can activate RFID reader 240 such that RFID reader 240 queries RFID tag 250 by sending a request signal to RFID tag 250. In response to the request signal, RFID tag 250 can generate or transmit a response signal that is received at RFID reader 240. In such a manner, controller 180 can determine that RFID reader 240 has received a signal from RFID tag 250.

At step 820, controller 180 permits a flow of water to water filter assembly 200, e.g., based at least in part on the signal of step 810. For example, controller 180 can adjust or actuate valve 172 to the open position in order to permit the flow of water to water filter assembly 200 if RFID reader 240 receives the signal from RFID tag 250 at step 810.

At step 830, controller 180 monitors RFID tag 250 with RFID reader 240 for an additional signal from RFID tag 250. For example, controller 180 can continuously or intermittently operate RFID reader 240 such that RFID reader 240 queries RFID tag 250 by sending a request signal to RFID tag 250. If RFID tag 250 receives the request signal from RFID reader 240, RFID tag 250 can generate or transmit the additional signal that is received at RFID reader 240 in response to the request signal. If RFID reader 240 receives the additional signal from RFID tag 250, controller 180 can determine that RFID reader 240 and RFID tag 250 are in signal communication with each other. Conversely, if RFID reader 240 does not receive the additional signal from RFID tag 250, controller 180 can determine that RFID reader 240 and RFID tag 250 are not in signal communication with each other. In such a manner, controller 180 can monitor RFID tag 250 with RFID reader 240 for an additional signal from RFID tag 250.

At step 840, controller 180 terminates the flow of water to water filter assembly 200 if RFID reader 240 does not receive the additional signal from RFID tag 250 at step 830. For example, controller 180 can adjust or actuate valve 172 to the closed position in order to terminate the flow of water to water filter assembly 200 if RFID reader 240 does not receive the additional signal from RFID tag 250 at step 830. Thus, if water filter assembly 200 is malfunctioning and RFID reader 240 does not receive the additional signal from RFID tag 250 at step 830, controller 180 can terminate the flow of water to water filter assembly 200.

Method 800 can also include notifying a user of refrigerator appliance 100 that water filter assembly 200 is malfunctioning if RFID reader 240 does not receive the additional signal from RFID tag 250 at step 830. For example, controller 180 can operate or activate at least one of visual display 182 and sound generator 184 in order to notify the user of refrigerator appliance 100 that water filter assembly 200 is malfunctioning.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for monitoring a water filter assembly within a refrigerator appliance, the water filter assembly having an RFID tag mounted to a filter cartridge of the water filter assembly, the refrigerator appliance having an RFID reader positioned proximate the RFID tag of the water filter assembly, the method comprising:

receiving a signal from the RFID tag of the water filter assembly at the RFID reader of the refrigerator appliance;

permitting a flow of water to the water filter assembly based at least in part on the signal of said step of receiving;

monitoring, during said step of permitting, the RFID tag of the water filter assembly with the RFID reader of the refrigerator appliance for an additional signal from the RFID tag of the water filter assembly; and terminating the flow of water to the water filter assembly if the RFID reader of the refrigerator appliance does not receive the additional signal from the RFID tag of the water filter assembly during said step of monitoring.

2. The method of claim 1, wherein said step of permitting comprises actuating a valve of the refrigerator appliance to an open position and said step of terminating comprises actuating the valve of the refrigerator appliance to a closed position.

3. The method of claim 1, further comprising notifying a user of the refrigerator appliance that the water filter assembly is malfunctioning if the RFID reader of the refrigerator appliance does not receive the additional signal from the RFID tag of the water filter assembly at said step of monitoring.

4. The method of claim 3, wherein said step of notifying comprises operating a visual display of the refrigerator appliance or a sound generator of the refrigerator appliance.

5. A method for monitoring a water filter assembly within a refrigerator appliance, the water filter assembly having an RFID tag mounted to a filter cartridge of the water filter assembly, the refrigerator appliance having an RFID reader positioned proximate the RFID tag of the water filter assembly, the method comprising:

establishing signal communication between the RFID tag of the water filter assembly and the RFID reader of the refrigerator appliance;

monitoring the signal communication between the RFID tag of the water filter assembly and the RFID reader of the refrigerator appliance; and terminating a flow of water to the water filter assembly if the signal communication between the RFID tag of the water filter assembly and the RFID reader of the refrigerator appliance is lost or disrupted during said step of monitoring.

6. The method of claim 5, further comprising initiating the flow of water to the water filter assembly after said step of establishing.

7. The method of claim 6, wherein said step of initiating comprises actuating a valve of the refrigerator appliance to an open position and said step of terminating comprises actuating the valve of the refrigerator appliance to a closed position.

8. The method of claim 5, further comprising notifying a user of the refrigerator appliance that the water filter assembly is malfunctioning if the signal communication between the RFID tag of the water filter assembly and the RFID reader of the refrigerator appliance is lost at said step of monitoring.

9. The method of claim 8, wherein said step of notifying comprises operating a visual display of the refrigerator appliance or a sound generator of the refrigerator appliance.

10. The method of claim 5, wherein the signal communication between the RFID tag of the water filter assembly and the RFID reader comprises receiving a signal from the RFID tag of the water filter assembly at the RFID reader.

11. A refrigerator appliance, comprising:

a cabinet that defines a chilled chamber for receipt of food articles for storage;

a water filter assembly mounted to the cabinet, the water filter assembly comprising a manifold that defines an inlet for receiving unfiltered water and an outlet for directing filtered water out of the water filter assembly;

a filter cartridge mounted to the manifold, the cartridge having a filtering media positioned therein for filtering a flow of water through the water filter assembly; and an RFID tag mounted to the filter cartridge;

an RFID reader mounted to the cabinet, the RFID reader positioned proximate the RFID tag of the water filter assembly; and a controller in communication with RFID reader, the controller configured for establishing signal communication between the RFID tag of the water filter assembly and the RFID reader;

monitoring the signal communication between the RFID tag of the water filter assembly and the RFID reader; and terminating a flow of water to the water filter assembly if the signal communication between the RFID tag of the water filter assembly and the RFID reader is lost or disrupted during said step of monitoring.

12. The refrigerator appliance of claim 11, wherein the RFID tag of the water filter assembly is positioned on an outer surface of the filter cartridge of the water filter assembly.

13. The refrigerator appliance of claim 11, wherein the cabinet defines an opening for permitting access to the chilled chamber of the cabinet, the cabinet having a door positioned at the opening of the cabinet for permitting selective access to the chilled chamber of the cabinet through the opening of the cabinet, the RFID reader mounted to the door of the cabinet.

14. The refrigerator appliance of claim 11, wherein the RFID tag of the water filter assembly comprises a passive RFID tag.

15. The refrigerator appliance of claim 11, further comprising a valve for regulating the flow of water to the water filter assembly, the valve configured for selectively shifting between a closed position and an open position, the valve permitting the flow of water to the water filter assembly in the open position, the valve obstructing the flow of water to the water filter assembly in the closed position, the controller in communication with the valve, the controller configured for adjusting the valve to the closed position at the step of terminating.

16. The refrigerator appliance of claim 15, wherein the controller is further configured shifting the valve to the open position in order to initiate the flow of water to the water filter assembly after said step of establishing.

17. The refrigerator appliance of claim 11, further comprising a visual display mounted to the cabinet, the controller in communication with the visual display, the controller configured for activating the visual display in order to notify a user of the refrigerator appliance that the water filter assembly is malfunctioning if the signal communication between the RFID tag of the water filter assembly and the RFID reader is lost at said step of monitoring.

18. The refrigerator appliance of claim 11, further comprising a sound generator mounted to the cabinet, the controller in communication with the sound generator, the controller configured for activating the sound generator in order to notify a user of the refrigerator appliance that the water filter assembly is malfunctioning if the signal communication between the RFID tag of the water filter assembly and the RFID reader is lost at said step of monitoring.

19. The refrigerator appliance of claim 11, wherein signal communication between the RFID tag of the water filter assembly and the RFID reader comprises receiving a signal from the RFID tag of the water filter assembly at the RFID reader.

* * * * *